United States Patent [19]

MacKiernan, Jr.

[11] 4,176,861

[45] Dec. 4, 1979

[54] BLANK CHECK SYSTEM

[76] Inventor: Stuart W. MacKiernan, Jr., 216 Messenger St., Canton, Mass. 02121

[21] Appl. No.: 886,227

[22] Filed: Mar. 13, 1978

[51] Int. Cl.[2] ..... B42D 11/00

[52] U.S. Cl. ..... 283/58; 206/39; 283/63 A

[58] Field of Search ..... 283/58, 63 A, 66 R; 206/39, 39.7; 282/9 R

[56] References Cited

U.S. PATENT DOCUMENTS

| | | | |
|---|---|---|---|
| 2,310,332 | 2/1943 | Wilbanks | 283/58 X |
| 3,048,426 | 8/1962 | Rodriguez et al. | 283/58 X |
| 3,058,758 | 10/1962 | Gouatsos | 283/58 X |
| 3,302,774 | 2/1967 | Zalkind | 206/39 |
| 3,421,658 | 1/1969 | Cooksey | 206/39 X |

*Primary Examiner*—Howard N. Goldberg

*Attorney, Agent, or Firm*—Ladas, Parry, Von Gehr, Goldsmith & Deschamps

[57] ABSTRACT

The subject matter relates to a blank check system which includes a stack of check blanks stacked in dispenser of plastic material. Each check blank has two parts connected at a fold line; the upper part being a blank check and the lower part being a duplicate or record portion. Upon partial withdrawal of the uppermost check blank from the frame to a predetermined position, the amount of the check being drawn may be entered and the remaining balance in the account may be inscribed on the next-succeeding check blank. The check may be fully withdrawn for completion, and the balance entered will be shown on the topmost remaining check blank to thereby provide a self-reconciling system of writing checks which automatically keeps a running balance.

20 Claims, 9 Drawing Figures

FIG. 1
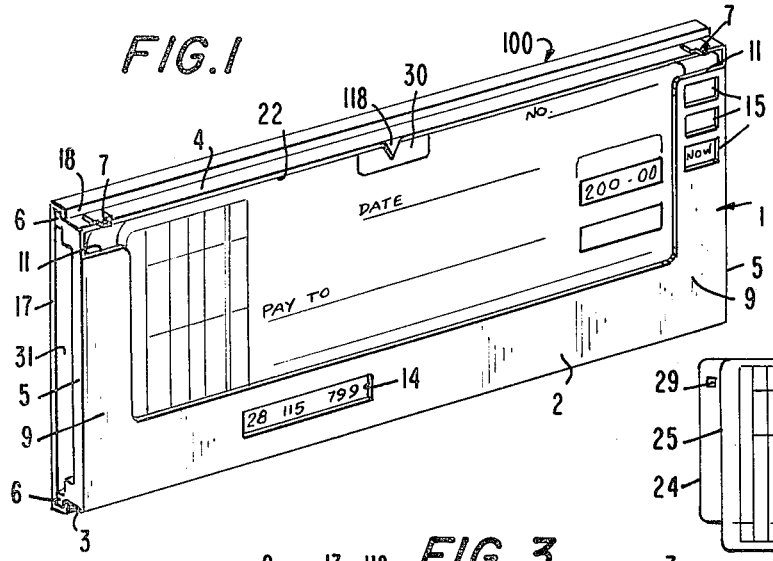
FIG. 5
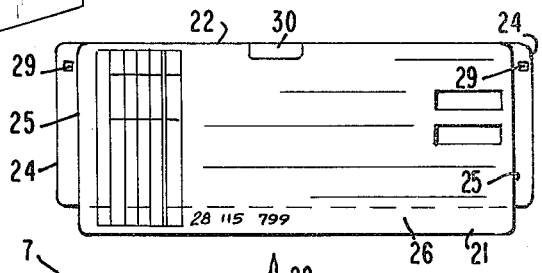
FIG. 3
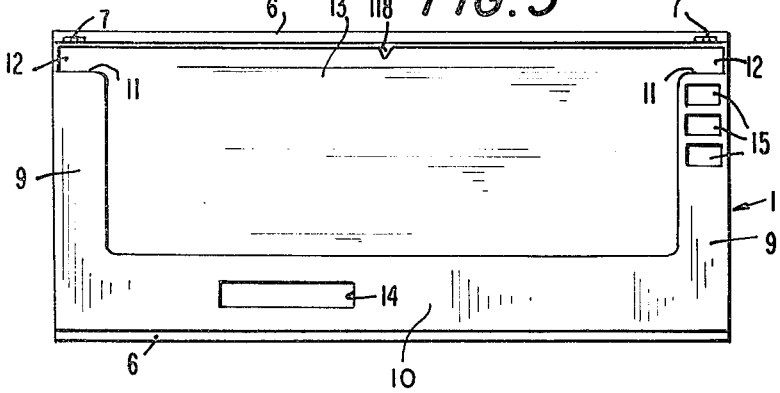
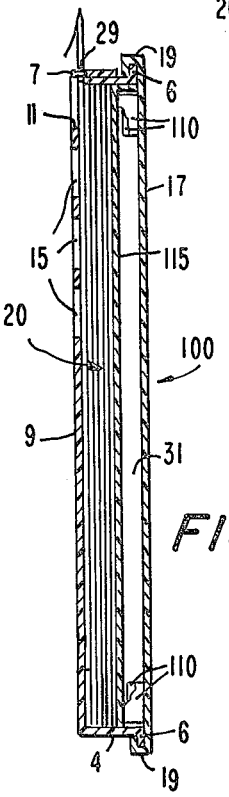
FIG. 8
FIG. 4
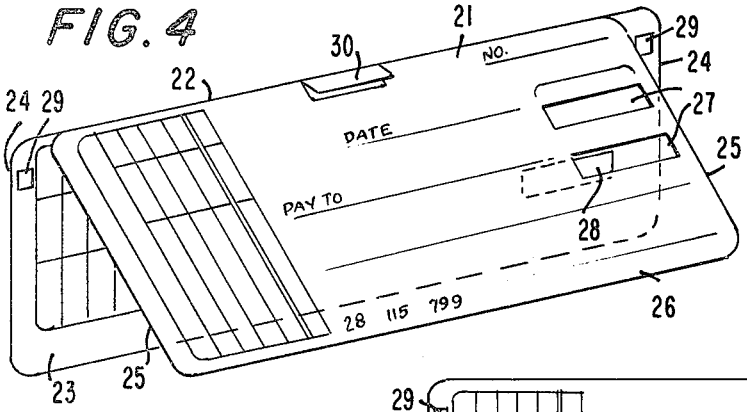
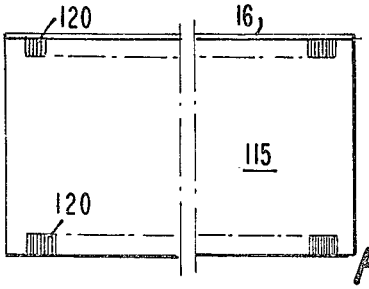
FIG. 9
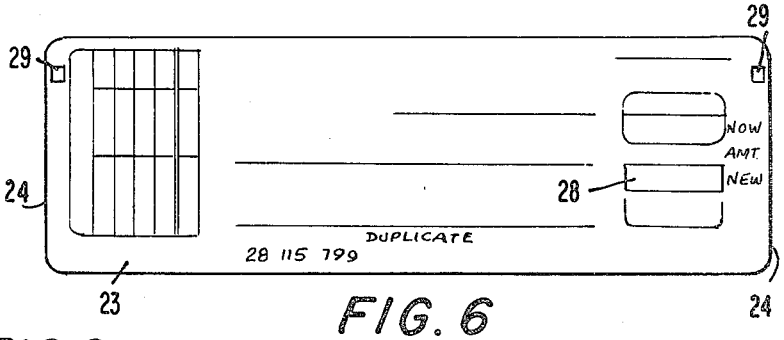
FIG. 6

BLANK CHECK SYSTEM

FIELD OF THE INVENTION

This invention relates to a blank check system, and more particularly to a novel assembly for housing a stack of check blanks which automatically provides the user with a running balance of the funds in the account as each check in the stack is written.

DISCUSSION OF THE PRIOR ART

The conventional blank check supply furnished to an account is in the form of a pad of blank checks attached at the upper edge by staples or adhesive means, and each check is removed by separating it from the pad as desired, usually along a serrated line at the upper edge of the check. Such pad is easily portable, but no record of the balance of the account is normally provided on the pad. A separate pad of record keeping blanks is available, and may be carried with the check blank supply in a suitable cover furnished by most banks. This system requires the writer of a check to draw the check and separately enter the pertinent data of said check on the other record keeping form. It is within the discretion of the writer of the check whether to calculate the remaining balance in the account when the check is recorded on such separate form. The disadvantage of this system is that many checks are drawn when the writer is in a hurry and either no data is recorded or only payee and the amount of the check is recorded and no running balance is maintained.

Of course, it is well known that business and individuals may use a supply of check blanks that are furnished with a record keeping portion that remains in the holder when the check is removed, but these pads are large and are intended for use at a desk and not for being carried in a pocket or handbag.

SUMMARY OF THE INVENTION

The present invention avoids the disadvantages of the prior art by providing a check writing system which is easily portable and which automatically provides a running balance in the account as each check is written.

The blank check system of this invention comprises a self-reconciling check system, which includes providing a plurality of check blanks stacked in a dispenser frame of plastic material, each check blank having the portions joined at a fold line, the upper portion being a conventional blank check and the lower portion adapted to be a duplicate or record of the check, said system comprising partially withdrawing the topmost check blank from the frame and while said blank is retained in said position entering thereon the amount of the check being drawn, entering the remaining balance in the account, and thereafter with the check blank in any convenient position completing the writing of the check in the usual manner, the remaining balance appearing on the next succeeding check blank when the said topmost check blank is fully removed from said dispenser frame.

It is an object of the invention to provide a blank check system which also provides a record of each check written which may be retained until a monthly statement is received from the bank so that the statement can be reconciled.

It is a further object of the invention to provide a blank check system which provides the user with a readily visible balance in the account before a check is written.

It is a still further object of the invention to provide a dispenser frame assembly for containing a supply of check blanks for the aforesaid blank check system.

The foregoing together with various ancillary objects, features and advantages of the present invention will become apparent from the following description of the preferred embodiment which is described herein and is illustrated in the attached drawings by way of example only.

BRIEF DESCRIPTION OF DRAWINGS

FIG. 1 is perspective view of dispenser frame assembly;

FIG. 3 is top view of cover member;

FIG. 4 is perspective view of a partly open check blank;

FIG. 5 is top view of a folded check blank;

FIG. 6 is top view of bottom sheet of a check blank;

FIG. 8 is a sectional view along line 8—8 in FIG. 7; and

FIG. 9 is a cut view of the undersurface of the intermediate member.

DETAILED DESCRIPTION OF DRAWINGS

Figure 2:
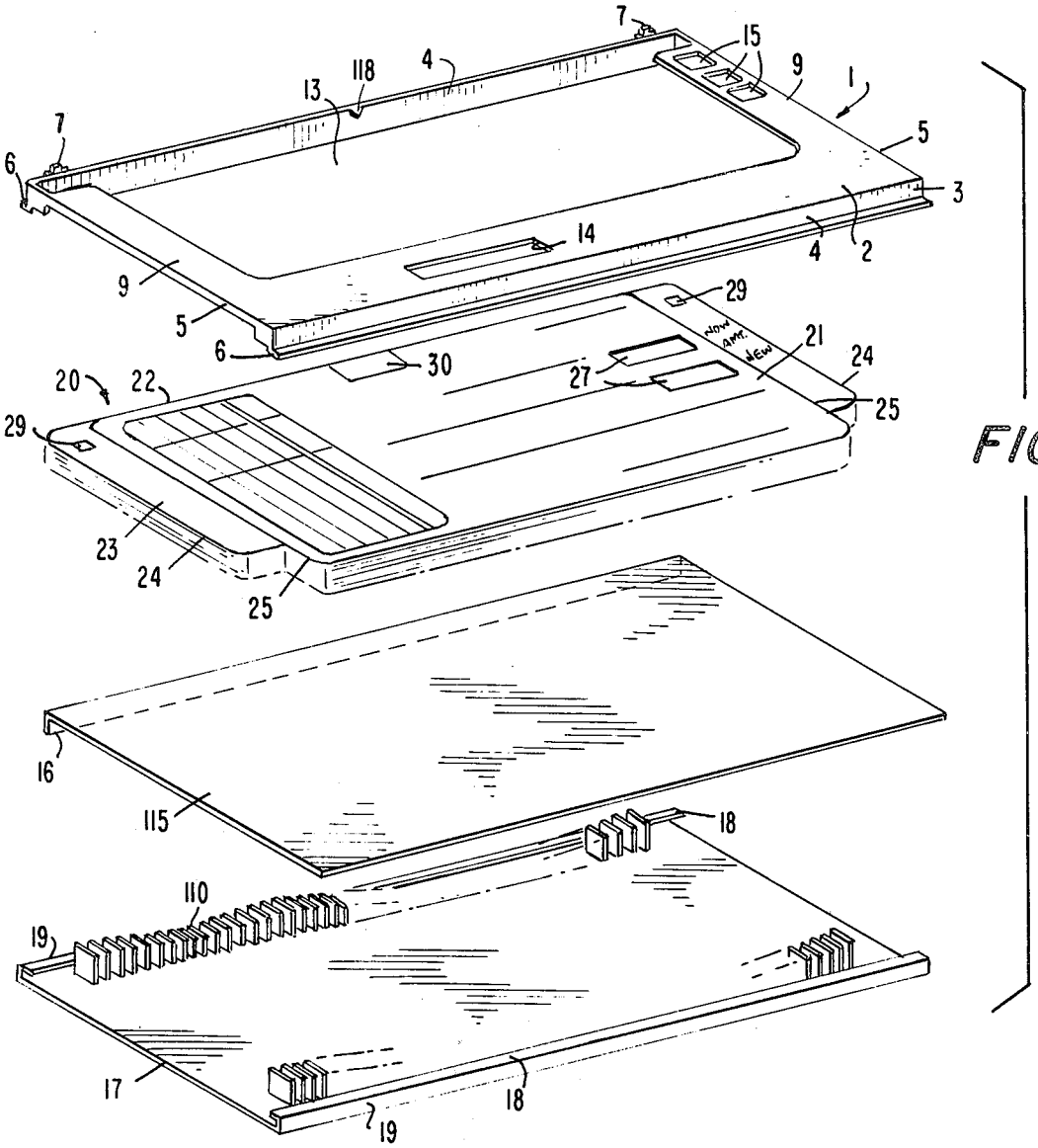
FIG. 2 is exploded view of dispenser frame assembly.

In the drawings, there is shown in FIG. 1 a dispenser frame assembly 100 for the blank check system of the present invention, which includes a cover member, a supply of check blanks, an intermediate member and a base member. The components of such assembly are shown individually in their proper relationship to each other in FIG. 2. The cover member 1 is made of plastic material and has a flat top surface portion 2 provided with a depending skirt portion 3. The top surface is rectangularly shaped and the skirt includes front and back portions 4 and side portions 5. The front and back portions and side portions of the skirt 3 are of equal height. The bottom edge of the front and back skirt portions 4 have a narrow transversely projecting portion 6. The projecting edge portions 6 may extend along the entire length of the front and back skirt portions 4 or may extend along only a major portion of the length of the front and back skirt portions. In the illustrated embodiment, an edge portion 6 projects from the front and back skirt portions 4 along substantially the entire length thereof. It would also be conceivable to use a discontinuous edge portion 6 along either one or both front and back skirt portions 4.

The upper edge of the back skirt portion 4 is provided with spaced-apart upstanding locator projections 7, each of which is near an outer end of the back skirt portion 4.

A small triangularly-shaped projection 118 is provided on the upper edge of the back skirt portion and which projects transversely to the plane of the back skirt portion 4 with the apex of said projection 118 toward the front skirt portion 4.

As seen in FIG. 3, the top surface of the cover member 1 has a U-shaped configuration, there being two leg portions 9 and a connecting portion 10. The upper end 11 of each leg portion 9 is spaced from the back skirt portion of the skirt to leave a narrow open slot 12. An open space 13 is located between leg portions 9. A narrow elongate aperture 14 is provided in the connecting portion of the top surface. A series of three rectangular apertures 15 are located in the upper end of one leg portion 9 at the right side of the top surface of the cover member 1. The rectangular apertures 15 are in alignment with each other and are spaced closely together lengthwise along the leg portion 9.

The upstanding locator projections 7 are centrally located in the illustrated embodiment with respect to the width of the adjacent leg portion 9 of the top surface of the cover member 1.

A rectangularly shaped flat intermediate member 115 is provided to fit within the skirt 3 on the cover member 1. The intermediate member 115 is provided with a narrow lip 16 projecting from one of its long edges at an angle of about 90° to the plane of said member. The lip 16 maintains the intermediate member 115 parallel to the surface of the upper cover member 1.

A base member 17 is also provided which is essentially a flat sheet of the plastic material and is rectangularly shaped and has approximately the same outer dimensions as the cover member 1. Releasable locking means 18 are provided on the two longitudinal edges 19 of the base member and which are interengageable with the projecting edge portions 6 on the front and back skirt portions 4.

The base member 17 is also provided with resilient biasing means 110 which projects from one surface thereof for contact with the intermediate member 115. When assembled, the biasing means 110 presses upon the intermediate member 115 which is in contact with the lowermost check blank in the pack and biases the pack upwardly towards the top surface of the cover member to thereby retain the remaining supply of check blanks in contact with the cover member as each check blank is withdrawn.

The biasing means 110 in in the illustrated embodiment is a plurality of small flat plastic rectangular members 110 which are flexible and which project outwardly from the surface of the base member 17. The members 110 may be molded integrally with the base member 17. However, the projecting members 110 could likewise be formed separately and mounted along the edges of the base member 17. The members 110 are formed in repeating series of members of increasing height, the lowest in one series following immediately after the tallest in the preceding series. The height of the shortest and tallest of the projecting members 110 is important. When assembled initially all of the projecting members 110, except the shortest will be bent over between the base member surface from which they project and the abutting surface of the intermediate member 115. The shortest members should be just tall enough to accommodate the normal supply of check blanks in the dispenser frame, with said pack of check blanks pressed against the cover member by the intermediate member 115. The surface of the intermediate member 115 contacted by the edges of the projecting members may be milled or provided with a continuous series of grooves 120 in any known manner. The free edge of the upstanding projecting members 110 will slip into one of these grooves 120. As the check blanks are withdrawn successively from the dispenser frame 100, the remaining blanks are biased upwardly by successively taller projecting members, as the latter are allowed to flex into an unbent configuration. The unbent projecting members 110, having their free edge in a groove 120 in the intermediate member 115 act as a support for the check blanks to maintain their position in the cover member 1 as various data is entered thereon by someone writing on the topmost check blank. The grooves 120 act to prevent the free edge of projections 110 from sliding relative to the surface of the intermediate member 115 as pressure is exerted on the topmost check blank by a writer of a check. The height of the tallest projection will permit it to be unflexed only when the last of the check blanks remain in the dispenser frame.

The depth of the cover member 1 could be made to accommodate a stack of any number of check blanks 20, but as a practical matter the desired number of check blanks is about 25 as the total height or thickness of the assembled unit should be about the same as the conventional checkbook in order to fit easily within a man's pocket or ladies pocketbook.

Other forms of resilient biasing means 110 could be chosen, such as springs or foam pads, but they must be capable of biasing the stack of check blanks upwardly against the cover member while providing a relatively rigid support to maintain the check blank steady in position at the opening in the cover member while being written upon.

A supply of individual check blanks 20 are also provided which will hereinafter be described in detail.

The unit may be assembled by placing a supply of stacked check blanks 20 on the upper surface of the interemdiate member 115. The cover member 1 is then placed over the check blank stack and the projecting edge portions 6 on the cover member 1 are slidably engaged with the releasable locking means 18 on the base member 1 and the base member 17 is moved therealong until it is in registry with the cover member to thereby form an assembled dispenser unit.

Each check blank 20 of the supply thereof is in a bipartite form with an upper sheet 21 connected by a fold line 22 at one edge to a lower sheet 23. When stacked the fold line 22 is oriented to face the rear edge of the cover, that is, the opening of the U. The upper sheet 21 is provided with printed matter to constitute a conventional blank check (FIG. 5). The lower sheet 23 has printed matter to constitute a record of the attached check (FIG. 6).

The lower sheet 23 is longer than the upper sheet 21 but is narrower than said upper sheet 21 so that when folded the lower sheet 23 of the sheet blank has two portions 24 extending beyond the outer edges 25 of the upper sheet 21, and the upper sheet 21 has a portion 26 at the bottom thereof which overlaps the free edge of the lower sheet 23 of the sheet blank 20 (See FIG. 5).

Two narrow rectangular apertures 27 are provided in the upper sheet 21 near one end thereof. A single narrow rectangular aperture 28 is provided in the lower sheet 23 which, when the sheet blank is in folded condition, will register with the lowermost of the two apertures 27 in the upper sheet 21.

The lower sheet 23 is additionally provided with two small apertures 29 near the corners of the sheet abutting the fold line 22.

As illustrated in FIG. 5, the upper sheet 21 is provided with blank spaces for writing a check in the usual way. The printed matter includes space for the check number, the date, the payee, the amount in both digits and writing, and the signature of the payor. A record section is provided at the left side of the check blank which has a space for recordal of all the pertinent information of that check in a normal way.

The space for writing the amount of the check is located between the two apertures 27 in the top check 21 of the sheet blank 20.

The lower sheet 23 may contain a record portion at the left side similar to that provided on the top sheet.

At the right side of the lower sheet, there is provided a box alongside the space for the date and which is in register with the upper aperture 27 in the top sheet 21 when the sheets are folded. The aperture 28 in the bottom sheet 23 registers with the lower aperture 27 in the top sheet 21 when in the folded condition.

The undersurface of the upper sheet 21 of each check blank is provided with pressure sensitive duplicating material, preferably in at least preselected data bearing areas of the upper sheet, that is, on the reverse side of the spaces for entering the data, the amount, and the payee on the check. The duplicating material could also be provided to underlie the record portion on the left side of the top sheet.

On the portion of the lower sheet 23 of each sheet blank 20 at its right side, that is, the portion of the lower sheet which extends beyond the edge of the right side of the top sheet, there is printed the words "Now," "Amount" and "New," in alignment, as shown in FIG. 6.

Each sheet blank 20 may be additionally provided with a tab 30 about midway along the fold line 22 which is cut from the upper sheet 21 to facilitate removal of the sheet blank 20 from the dispenser frame assembly.

OPERATION OF THE CHECK SYSTEM OF THE PRESENT INVENTION

The dispenser frame assembly is provided as a unit with a stack of check blanks 20 located under the top surface of the cover unit 1. The resilient means 110 on the intermediate member 115 will bias the stack upwardly in a direction to press against the cover member 1 and to be kept in contact therewith as the check blanks 20 are successively withdrawn. The tab 30 of the uppermost check blank 20 is normally retained within the plane of the check blank by the projection 118 which overlies the tab 30.

Figure 7:
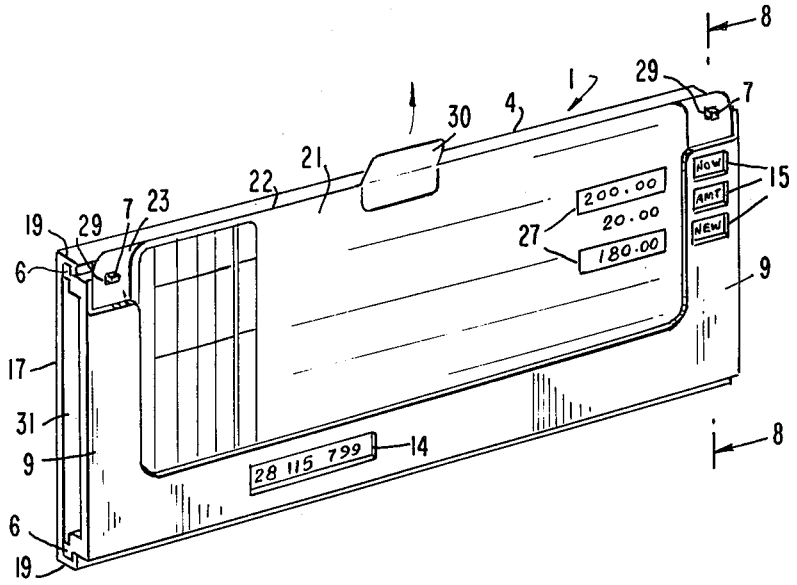
FIG. 7 is perspective view of assembly with partially withdrawn check blank.

When a check is to be drawn, the tap 30 of the topmost check blank 20 on the stack is grasped and is pulled upwardly and outwardly to partially withdraw from the cover member 1 and topmost check blank through the open slots 12 between the free edges of the legs of the U of the top surface of the cover member 1 and the edge of the back skirt portion 4. The check blank is maintained at a position where the openings 29 at the upper corners of the lower part of the check blank are engaged by the locator projections 7 on the upper edge of the back skirt portion 4. In this position, lower aperture 27 in the top sheet 21 and aperture 28 in the bottom sheet 23 of the uppermost check blank 20 will be in register with upper aperture 27 in the top sheet 21 of the next succeeding check blank 20 in the stack. The balance in the account has been pre-entered in the portion of the bottom sheet showing through the upper aperture of the top sheet in the topmost check blank. The word "now" on the lower sheet of the check blank 20 appears in the uppermost aperture 15 on the top surface of the cover member 1 alongside the pre-entered balance. (See FIG. 7).

The amount of the check being drawn is entered in digits in the allocated space on the topmost check blank 20. The symbol "Amt" (amount) appears in the middle of the three apertures 15 in the top surface of the cover member 1 alongside the figure now entered on the check blank 20 for the check being drawn. A subtraction is made by the writer of the check to determine the new balance and this amount is entered in the space provided by the lower aperture 27 in the topmost check blank 20. The amount is actually recorded on the next succeeding check blank 20 through the registered apertures 27,28 in the topmost check blank which are also now in register with the upper aperture 27 in such next succeeding check blank. The word "new" on the lower sheet 23 of the topmost check blank 20 appears in the lowermost of the three apertures 15 in the top surface of the cover member 1 alongside the calculated new balance.

The check may now be completed by entering thereon the remaining data, such as, the date, the payee, the amount in words, and the signature of the payor. The topmost check blank 20 is then fully withdrawn from the dispenser unit. Other pertinent information with regard to that check may then be entered in the record portion on the left side of the top sheet 21.

The check may be separated from the attached lower sheet at the fold line 22 which may be serrated to facilitate such separation. The data entered on the check over the preselected areas of duplicating material on the undersurface thereof will then appear on the lower sheet, and if desired, any other pertinent data may be additionally entered thereon. The lower sheet may be retained for the payor's records.

After the check is written, the next succeeding check blank 20 which now appears at the surface of the cover member 1 has recorded thereon the balance previously calculated and entered thereon, when the check was written, and such amount appears through the upper aperture 27 in the upper sheet 21 and alongside the word "Now" which is seen through the lowermost of the three apertures 15 in the top surface of the cover member 1, as in FIG. 1.

The duplicate of the check written, that is, the lower sheet 23 of the first check blank 20 for the check drawn, may be stored in the dispensing unit if desired. The duplicate may be stored in the dispenser frame in the space between the cover member 1 and the opposed series of resilient means 110 on the base member 17. A recess 31 is provided at the bottom edge of one side portion 5 of the skirt of the cover member to afford access to the above storage space for the duplicates in the dispenser frame.

The number of the account on which the check is being drawn which is pre-printed on each check appears through the aperture 14 in the connecting portion 10 of the U-shaped top surface of the cover member 1.

When the next check is drawn, the same procedure is utilized, and the aforesaid calculated balance is used as the starting point for the bank record information. The amount of the next check is entered thereon, and the new balance calculated and entered and thereby recorded on the next lowermost check blank 20, that is, the third check blank in the stack. This process is then repeated for each check blank in the stack when needed and the balance will be carried forward at each step in accordance with the aforesaid procedure.

When all of the checks in the stack are completed, the dispenser frame may be retained for storage of the duplicates contained therein until the bank statement is reconciled, at which time, the dispenser may be discarded.

I claim:

1. A check writing system, which includes providing a plurality of check blanks stacked in a dispenser frame made of plastic material, each check blank having two portions joined at a fold line, the upper portion being a conventional blank check and the lower portion adapted to be a duplicate or record of the check, said system comprising partially withdrawing the topmost check blank from the frame to a predetermined position, and, while said blank is retained in said position, entering thereon the amount of the check being drawn and entering the remaining balance in the account, and thereafter, with the check blank in any convenient position, completing the writing of the check in the usual manner, the remaining balance being inscribed on the next succeeding check blank when the said topmost check blank is fully removed from said dispenser frame.

2. A check writing system as defined in claim 1, wherein the remaining balance is inscribed on a preselected area on the lower portion of the next succeeding check blank.

3. A check writing system as defined in claim 1, wherein the upper portion of the check blank has two apertures near the right side aligned one above the other, the lower portion of said check blank having a single aperture which is in registry with the lowermost of the apertures in the upper portion when the check blank is in the folded condition, the registered apertures in the topmost check blank being aligned with the uppermost aperture in the upper sheet of the next succeeding check blank whereby the remaining balance, with the topmost check blank in its partially withdrawn position, is entered on a pre-selected area on the lower sheet of the next succeeding check blank.

4. A check writing system as defined in claim 1, wherein the lower portion of the check blank has portions extending beyond the side edges of the upper portion, one said extending portion having printed thereon in vertical alignment the words "Now," "Amount," and "New," said words being adapted to be visible through apertures in the cover of said dispenser frame.

5. A check writing system as defined in claim 4, wherein the word "Now" appears in an aperture in the dispenser frame cover with the check blank positioned within the cover to designate the current balance appearing alongside said word on the topmost check blank in the stack, and after movement of said check blank to the predetermined partially withdrawn position, the words "Now," "Amount" and "New" appear through aligned apertures in the cover to designate respectively the current balance, the amount of the check to be drawn, and the new balance.

6. A check writing system as defined in claim 1, wherein the stack of check blanks is biased upwardly toward an opening in the dispenser frame to thereby maintain successive check blanks in position for writing a check, as each is removed from the dispenser frame.

7. A check writing system as defined in claim 6, wherein a storage space is provided in the dispenser frame so that the lower portion of each check blank may be retained in said space for record keeping purposes as each check is drawn.

8. A self-reconciling check dispenser assembly which comprises a container made of plastic material, a supply of check blanks being provided in the container for successive removal through an opening in said container, and means to enable a check to be written and, prior to complete removal thereof from said container, to facilitate entry of the remaining balance in the account to be made on the next succeeding check blank.

9. A check dispenser assembly as defined in claim 8, wherein the container includes a rectangular base member and a cover member removably mounted thereon, there being retaining means on the base member slidably engaging projecting means on the cover member.

10. A check dispenser assembly as defined in claim 9, wherein the cover member has a generally U-shaped upper surface, one leg of said surface having three apertures in alignment along the longitudinal axis of said leg, the word "Now" being visible through the overmost aperture when the check blank is positioned within the cover member.

11. A check dispenser assembly as defined in claim 10, wherein the words "Now," "Amount" and "New" appear in that order in the aligned apertures in the cover member when the check blank is moved to a predetermined position partially withdrawn from the container.

12. A check dispenser assembly as defined in claim 11, wherein upstanding locator projections are provided on a back wall of the container, and an aperture is formed in the upper corner of each check blank, the locator projections being positioned in said apertures to retain the check blank in its predetermined partially withdrawn position.

13. A check dispenser assembly as defined in claim 12, wherein a slot is provided between the top surface of the cover member and the back wall of the container through which the check blank is movable for withdrawal from the container.

14. A check dispenser assembly as defined in claim 8, which includes a thin flat rectangularly shaped intermediate member between the supply of check blanks and the base member, there being resilient means on the base member pressing against the intermediate member to bias the supply of check blanks toward an opening in the cover member through which the checks are removable.

15. A check dispenser assembly as defined in claim 14, wherein the resilient biasing means comprise a plurality of upstanding projections on the base member, there being at least one series of projections of different heights arranged longitudinally of the base member along each of the outer long edges thereof.

16. A check dispenser assembly as defined in claim 15, wherein the series of upstanding projections is molded integrally with the base member.

17. A check dispenser assembly as defined in claim 15, wherein the height of the shortest projection in each series permits said projection to remain unbent when the supply of check blanks is full, and the height of the longest projection in each series permits said projection to be unbent when the supply of check blanks is almost exhausted.

18. A check dispenser assembly as defined in claim 15, wherein grooves are provided in one surface of the intermediate member overlying the upstanding projections and which are adapted to receive the projections in an unbent condition to thereby provide rigid support for the check blanks in the container.

19. A check dispenser assembly as defined in claim 8, wherein each check blank in the supply pad comprises an upper portion and a lower sheet joined at a fold line therebetween, the upper portion of the check blank has two apertures near the right side aligned one above the other, the lower portion of said check blank having a single aperture which is in registry with the lowermost of the apertures in the upper portion when the check blank is in the folded condition, the registered apertures in the topmost check blank being aligned with the uppermost aperture in the upper sheet of the next succeeding check blank.

20. A check dispenser assembly as defined in claim 19, wherein the lower portion of the check blank has portions extending beyond the side edges of the upper portion, one said extending portion having printed thereon in vertical alignment the words "Now," "Amount," and "New."

* * * * *